US011729538B2

(12) United States Patent
Chng et al.

(10) Patent No.: US 11,729,538 B2
(45) Date of Patent: Aug. 15, 2023

(54) MICROPHONE MODULE

(71) Applicant: Waymo LLC, Mountain View, CA (US)

(72) Inventors: Choon Ping Chng, Los Altos, CA (US); Cheng-Han Wu, Sunnyvale, CA (US); Jun Hou, Shanghai (CN); Xuan Zhong, San Jose, CA (US)

(73) Assignee: Waymo LLC, Mountain View, CA (US)

( * ) Notice: Subject to any disclaimer, the term of this patent is extended or adjusted under 35 U.S.C. 154(b) by 0 days.

(21) Appl. No.: 17/685,480

(22) Filed: Mar. 3, 2022

(65) Prior Publication Data

US 2022/0191604 A1 Jun. 16, 2022

Related U.S. Application Data

(63) Continuation of application No. 16/939,647, filed on Jul. 27, 2020, now Pat. No. 11,303,980.

(51) Int. Cl.

| | |
|---|---|
| ***H04R 1/04*** | (2006.01) |
| ***H04R 1/22*** | (2006.01) |
| ***H04R 1/08*** | (2006.01) |

(52) U.S. Cl.

CPC ..... *H04R 1/04* (2013.01); *H04R 1/08* (2013.01); *H04R 1/222* (2013.01); *H04R 2499/13* (2013.01)

(58) Field of Classification Search

None

See application file for complete search history.

(56) References Cited

U.S. PATENT DOCUMENTS

| | | | |
|---|---|---|---|
| 5,491,478 | A | 2/1996 | de la Luz et al. |
| 5,812,496 | A | 9/1998 | Peck |
| 7,136,494 | B2 | 11/2006 | Watson et al. |
| 7,218,742 | B2 | 5/2007 | Kay et al. |
| 8,272,517 | B2 | 9/2012 | Horie et al. |
| 9,078,063 | B2 | 7/2015 | Loeppert et al. |
| 9,132,270 | B2 | 9/2015 | Vaishya |
| 9,204,229 | B2 | 12/2015 | Koester et al. |
| 9,253,297 | B2 | 2/2016 | Abe et al. |
| 9,414,141 | B2 | 8/2016 | Cohen et al. |

(Continued)

FOREIGN PATENT DOCUMENTS

| | | | |
|---|---|---|---|
| CN | 200956661 | Y | 10/2007 |
| KR | 10-1146513 | B1 | 5/2012 |

OTHER PUBLICATIONS

D. Ugarte et al., "Acoustical Characterizatio nof Impermeable Membranes: Hearing Air Applications", Proceedings of the 25th Annual International Conference of the IEEE Engineering in Medicine and Biology Society (IEEE Cat. No. 03CH37439), Sep. 17-21, 2003.

(Continued)

*Primary Examiner* — Kenny H Truong

(74) *Attorney, Agent, or Firm* — McDonnell Boehnen Hulbert & Berghoff LLP

(57) ABSTRACT

A sensor module comprising a housing defining an internal cavity, the housing including an aperture, at least one microphone positioned in the internal cavity spaced from the aperture, a first barrier proximate the aperture, and a second barrier positioned between the at least one microphone and the first barrier.

20 Claims, 7 Drawing Sheets

(56) References Cited

U.S. PATENT DOCUMENTS

| | | | | |
|---|---|---|---|---|
| 10,587,942 | B1 | 3/2020 | Minervini et al. | |
| 10,631,073 | B2 | 4/2020 | Schipper | |
| 11,303,980 | B2 | 4/2022 | Chng et al. | |
| 2007/0003081 | A1 | 1/2007 | Ram et al. | |
| 2007/0113964 | A1 | 5/2007 | Crawford et al. | |
| 2010/0111345 | A1 | 5/2010 | Andrea et al. | |
| 2011/0255728 | A1 | 10/2011 | Abe et al. | |
| 2017/0366889 | A1* | 12/2017 | Schipper | H04R 1/086 |
| 2018/0103307 | A1 | 4/2018 | Hansson | |
| 2019/0191242 | A1 | 6/2019 | Shin et al. | |
| 2019/0277962 | A1 | 9/2019 | Ingram et al. | |
| 2020/0084539 | A1 | 3/2020 | Lippert et al. | |
| 2020/0280782 | A1 | 9/2020 | Kleinheincz et al. | |

OTHER PUBLICATIONS

International Search Report and Written Opinion dated Nov. 19, 2021, issued in connection with International Application No. PCT/US2021/042801, filed Jul. 22, 2021, 9 pages.

* cited by examiner

MICROPHONE MODULE

CROSS-REFERENCE TO RELATED APPLICATIONS

This application is a continuation of U.S. patent application Ser. No. 16/939,647, filed Jul. 27, 2020, which is incorporated herein by reference.

BACKGROUND

A vehicle can include one or more sensors mounted to the outside of the vehicle that are configured to collect audio signals about the environment in which the vehicle operates. The outside location exposes the one or more sensor to a number of environmental hazards, including precipitation, dust, debris, high winds, ice, and extreme temperatures.

The one or more sensors can include acoustic sensors, such as a microphone. Microphones often include delicate components, such as a diaphragm, configured to vibrate in response to sound. To operate, the diaphragm is exposed to a fluid, such as air, through which the sound is being transmitted. However, the diaphragm can be damaged by exposure to the above mentioned environmental hazards. High wind can also cause the diaphragm to vibrate, thus obscuring the target acoustic signal.

SUMMARY

A vehicle may include various sensors to detect aspects of the environment surrounding the vehicle. In some examples, the vehicle includes a microphone module containing one or more microphones for detecting sounds originating outside of the vehicle. The microphone module includes a housing having an internal cavity and an aperture connecting the internal cavity to the exterior of the housing. At least one microphone is positioned within the internal cavity, spaced apart from the aperture.

The microphone module further includes a first barrier proximate the aperture and a second barrier between the first barrier and the microphone. In one example, the microphone module further includes a third barrier between the second barrier and the microphone.

In some examples, the barriers provide escalating levels of ingress protections. For example, the first barrier can be a rigid mesh configured to protect against ingress by debris. The second barrier can a fabric mesh configured to protect against ingress by dust. The third barrier is a water impermeable membrane configured to protect against ingress by liquid, such as water.

In some examples, the first barrier has a perforation ratio that is at least 10%. In further examples, the first barrier has a perforation ratio that is at least 33%. Additionally, the first barrier may have a resonance peak above the usable frequency band's higher limit, e.g. 10 kHz.

In some examples, the second barrier has an acoustic impedance less than or equal to about 100 ohm/cm$^2$. Additionally, the second barrier could have an ingress protection ratio of at least IP50, such as IP54. In some implementations, the second barrier comprises a polyester monofilament fabric.

In some examples, the vehicle includes additional sensor systems, such as camera, LIDAR, SONAR, and/or RADAR. In one example, the vehicle is an autonomous vehicle.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
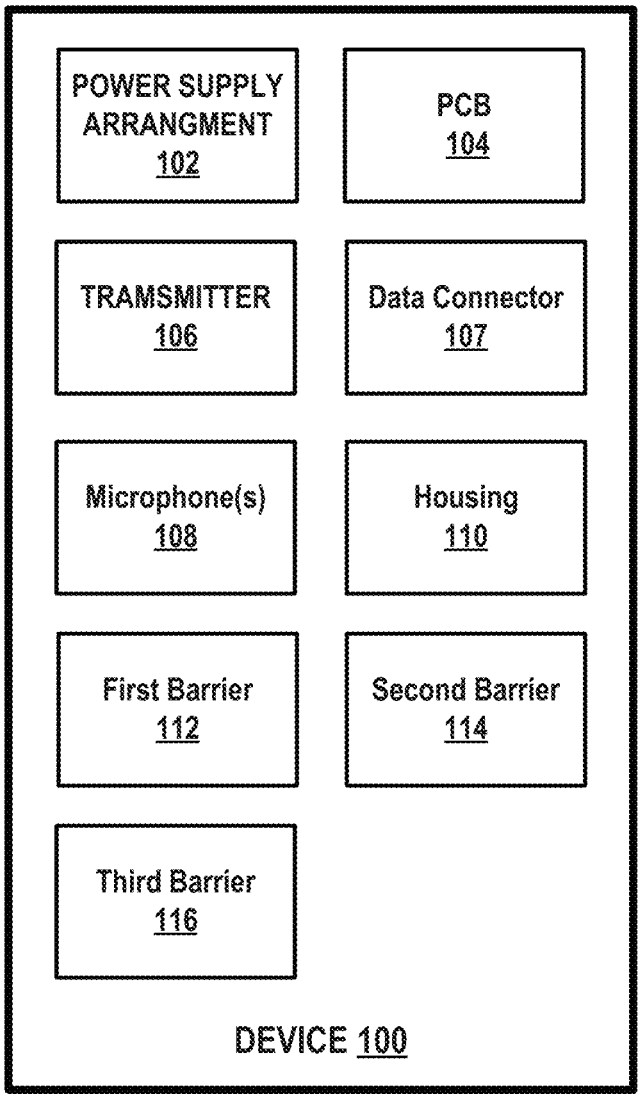
FIG. 1 is a simplified block diagram of a device, according to an example embodiment.

Exemplary implementations are described herein. It should be understood that the word "exemplary" is used herein to mean "serving as an example, instance, or illustration." Any implementation or feature described herein as "exemplary" or "illustrative" is not necessarily to be construed as preferred or advantageous over other implementations or features. In the figures, similar symbols typically identify similar components, unless context dictates otherwise. The example implementations described herein are not meant to be limiting. It will be readily understood that the aspects of the present disclosure, as generally described herein, and illustrated in the figures, can be arranged, substituted, combined, separated, and designed in a wide variety of different configurations.

When used herein, "water tight seal" does not necessarily prevent all water from entry in any condition, such as long term submersion. A water tight seal may be a seal that prevents water entry from water spray, water jets, and/or limited submersion. For example, a water tight seal as used herein may have an Ingress Protection ("IP") rating of at least IP62, IP63, IP64, IP65, IP66, or IP67. Similarly, a "dust tight seal" as used herein may not prevent all dust from entry. A dust tight seal prevents dust from entering in sufficient quantities to interfere with satisfactory operation of the device. For example, a dust tight seal may have a solids rating of at least IP5x or IP6x.

A vehicle, such as an autonomous vehicle, includes a number of external sensors for detecting aspects of the environment around the vehicle. Various types of active sensors, such as camera, LIDARs, RADARs, SONARs, etc., may be included in a vehicle to detect obstacles or objects in an environment of the vehicle and thereby facilitate accident avoidance and/or autonomous operation, among other possibilities. In addition, it can be advantageous to include sensors that can detect audio signals that represent abnormal and safety-critical events such as sirens, horns, back-up alarms, railroad crossing signals, and screeching brakes.

In some embodiments, a vehicle is equipped with one or more microphone modules exposed to the air outside of the vehicle. The microphone modules include one or more microphones that detect sound outside of the vehicle and transmit audio data to a processor. The processor can analyze the audio data to determine if specific sounds were detected, such as sirens.

The microphone module includes a housing having an internal cavity. One or more microphones are positioned in the internal cavity. An aperture or opening extends through the outer wall of the housing, connecting the cavity to the outside. A first barrier is positioned proximate the mouth of the aperture. The first barrier includes a rigid structure having one or more holes or pores therein, such as a metal or plastic mesh. The first barrier inhibits the passage of debris through the aperture, while allowing air and sound to enter the housing through the pores therein. A second barrier is positioned between the first barrier and the microphone. The second barrier is configured to inhibit the passage of dust and reduces the ingress by water.

In some examples, the microphone module includes a third barrier positioned between the second barrier and the microphone. The third barrier is configured to inhibit the passage of water, thus forming a water tight seal around the microphone. In some forms, the third barrier is air permeable, allowing air and thus sound to reach the microphone. In alternative forms, the third barrier is air impermeable. However, the air impermeable membrane is configured to vibrate in response to sound, thus recreating the sound in the microphone chamber.

Turning now to the figures, FIG. 1 is a simplified block diagram of a device 100, according to an example embodiment. As shown, device 100 includes a power supply arrangement 102, a circuit board 104, a transmitter 106, a data connector 107, one or more microphones 108, a housing 110, a first barrier 112, a second barrier 114, and a third barrier 116. In other embodiments, device 100 may include more, fewer, or different components. For example, the transmitter 106 can optionally be a wireless transmitter configured to transmit audio data from the microphone(s) 108, thus allowing the data connector 107 to be removed. Additionally, the components shown may be combined or divided in any number of ways.

Power supply arrangement 102 may be configured to supply, receive, and/or distribute power to various components of device 100. To that end, power supply arrangement 102 may include or otherwise take the form of a power source (e.g., battery cells, etc.) disposed within device 100 and connected to various components of the device 100 in any feasible manner, so as to supply power to those components. Additionally or alternatively, power supply arrangement 102 may include or otherwise take the form of a power adapter configured to receive power from one or more external power sources (e.g., from a power source arranged in a vehicle to which device 100 is mounted) and to transmit the received power to various components of device 100.

The circuit board 104 may include one or more electronic components and/or systems arranged to facilitate certain operations of device 100. The circuit board 104 may be disposed within device 100 in any feasible manner. In one embodiment, the circuit board 104 may be disposed, at least partially, within a central cavity region of the housing 110 such that the microphone(s) is mounted directly onto the circuit board 104.

The circuit board 104 includes or is otherwise coupled to tracing or wiring used for transfer signals to and between various components of device 100. Generally, the circuit board 104 communicably couples the microphone(s) 108 to the transmitter 106 so that audio data from the microphone(s) 108 can be sent to the transmitter 106. In some forms, the circuit board 104 further connects the transmitter 106 to the data connector 107, enabling the audio data to be transmitted by the transmitter 106 to an external processor by way of the data connector 107.

In some examples, the circuit board 104 includes components for processing the audio data prior to transmission. Example processing performed at the circuit board 104 can include filtering, compressing, and converting. To that end, the circuit board 104 may include one or more processors, data storage, and/or electronic filters.

The transmitter 106 may be configured to transmit a signal toward an environment of the device. In one form, the transmitter 106 is a wired transmitter configured to transmit a signal through the data connector 107. The data connector 107 is a port and/or cable that couples the device 100 to an external processor, such as a central sensor data processor of the vehicle. In one example, the data connector 107 is a High Speed Data ("HSD") connector. In alternative forms, the transmitter 106 is a wireless transmitter, such as Bluetooth, BLE, infrared, Wi-Fi, or cellular transmitter, configured to wirelessly transmit data from the device 100 to the external processor.

The microphone(s) 108 is one or more microphones positioned within the housing 110. In some examples, the microphone(s) 108 is an integrated circuit microphone mounted directly to the circuit board 104. The microphone(s) 108 is exposed to sound originating outside of the vehicle, for example by being disposed within an air permeable cavity.

The housing 110 is a rigid housing defining a cavity containing the microphone(s) 108. The housing 110 includes one or more apertures allowing fluid communication between the cavity and the exterior of the vehicle. In some examples, the housing 110 is configured to mount to the exterior of a vehicle. In alternative examples, the housing 110 is at least partially located within the vehicle but with the cavity in fluid communication with the exterior of the vehicle. In some forms, the housing 110 is part of a larger housing containing additional sensor devices, such as LIDARs, RADARs, SONARs, and/or cameras.

The device 100 includes a plurality of barriers 112, 114, 116 located between the microphone(s) 108 and the aperture. The barriers 112, 114, 116 have decreasing levels of permeability, such that different environmental hazards are inhibited at each barrier. In some examples, the first barrier 112 is a rigid mesh configured to at least partially inhibit debris from entering the cavity. The second barrier 114 is a water permeable fabric, such as a polyester monofilament fabric, located between the first barrier 112 and the microphone(s) 108. The second barrier 114 at least partially inhibits dust from passing therethrough. In some forms, the second barrier 114 is at least partially water resistant. In one example, the second barrier 114 includes a hydrophobic coating. The third barrier 116 is a water impermeable material, such as Gore-Tex® or Gore-Vent®, which provides a water tight seal around the portion of the cavity containing the microphone(s) 108. In some examples, one of the second barrier 114 or third barrier 116 is removed.

FIGS. 2A-2D illustrate a microphone module 200 according to an example embodiment. In some examples, the microphone module 200 may be similar to device 100. For example, as shown, the microphone module 200 includes a power supply arrangement 202, a circuit board 204, a transmitter 206, a data connector 207, one or more microphones 208, a housing 210, a first barrier 212, a second barrier 214, and a third barrier 216 which may be similar, respectively, to power supply arrangement 102, circuit board 104, transmitter 106, data connector 107, microphone(s) 108, housing 110, first barrier 112, second barrier 114, and third barrier 116.

As shown, the housing 210 has multiple apertures 232 each connecting the exterior to a respective cavity 230. Each cavity 230 contains substantially similar structure including a plurality of barriers 212, 214, 216, and a microphone 208. For clarity, only the structures within only one of the cavities 230 are numbered.

The housing 210 has an elliptical sidewall 234, a top cap 236, and a bottom wall 238. In some forms, the sidewall 234 and bottom wall 238 are integrally formed with each other. The top cap 236 is detachably coupled to the sidewall 234. A top cap seal 237 is positioned between the top cap 236 and the sidewall 234 to form a water tight seal therebetween.

The top cap 236 includes an air permeable barrier 235. The air permeable barrier 235 allows pressure to equalize between the exterior of the module 200 and the circuit board cavity 204A. The air permeable barrier 235 inhibits ingress of dust and water, protecting the circuit board 204 from environmental hazards. In one form, the housing 210 has an ingress protection rating of at least IP67 with respect to the circuit board cavity 204A.

The data connector 207 is accessible through the top cap 236 to operably couple to the circuit board 204. The top cap 236 includes a data connector retainer 207C configured to detachably couple to a data cable in order to secure the cable to the module 200. The data connector retainer 207C is detachably coupled to the top cap 236 by screws 207A. It is understood that other structures can be used in place of the screws 207A to couple the data connector 207 to the top cap 236, such as retaining clips. A seal 207B is positioned between the data connector retainer 207C and the top cap 236, providing a water tight seal therebetween. In some examples, the data connector 207 includes one or more power pins and thus serves as a power supply arrangement 202 providing power from the vehicle to the microphone module 200. The data connector 207 is mounted on the circuit board 204.

In some forms, the housing 210 includes an attachment structure for coupling the microphone module 200 to a vehicle. In the shown embodiment, the attachment structure includes a plurality of screws 239. It is understood that other attachment structures can be used, such as bolts, clips, and/or adhesives.

Figure 2A:
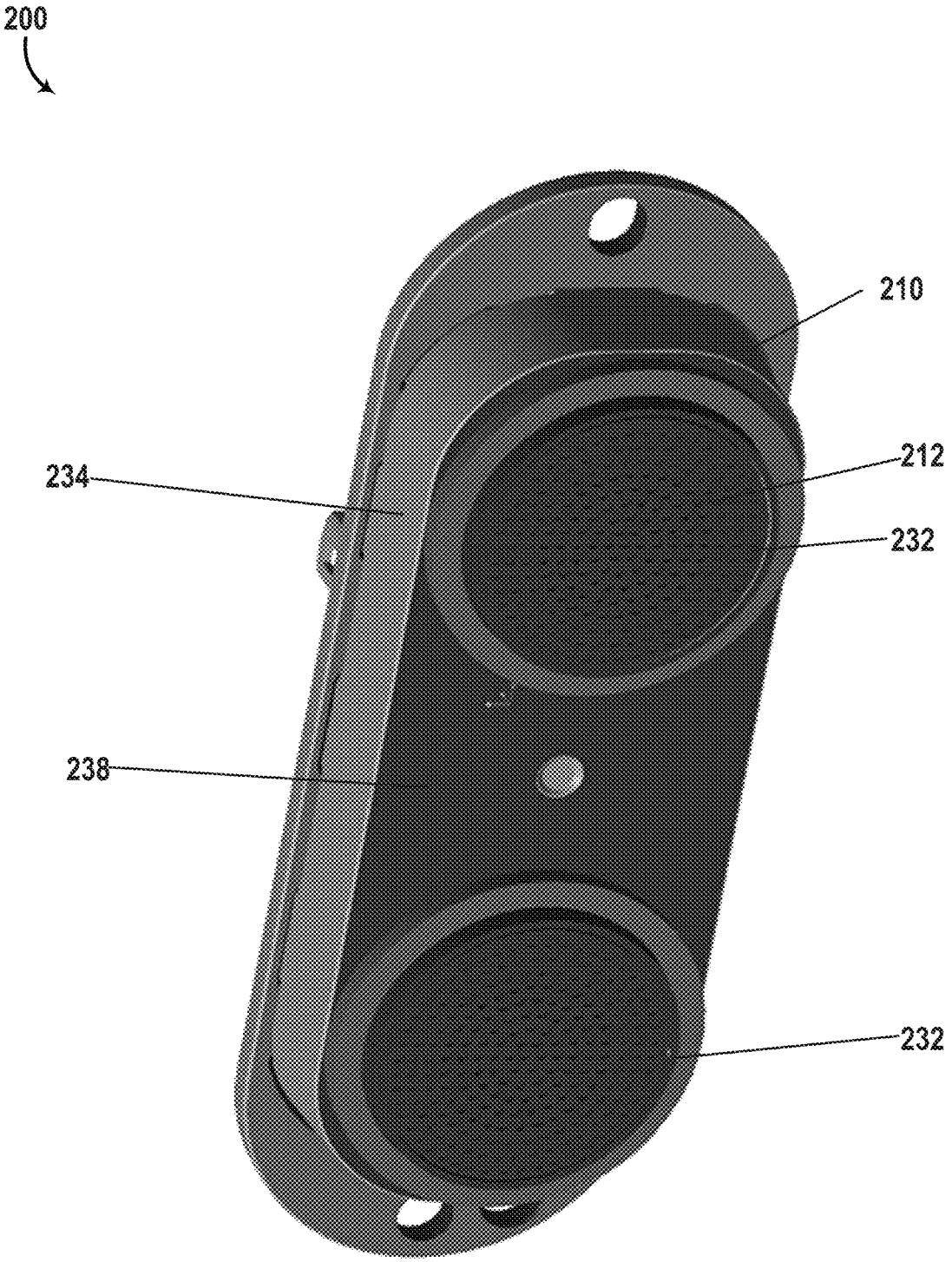
FIG. 2A is a front perspective view of a microphone module, according to an example embodiment.
Figure 2B:
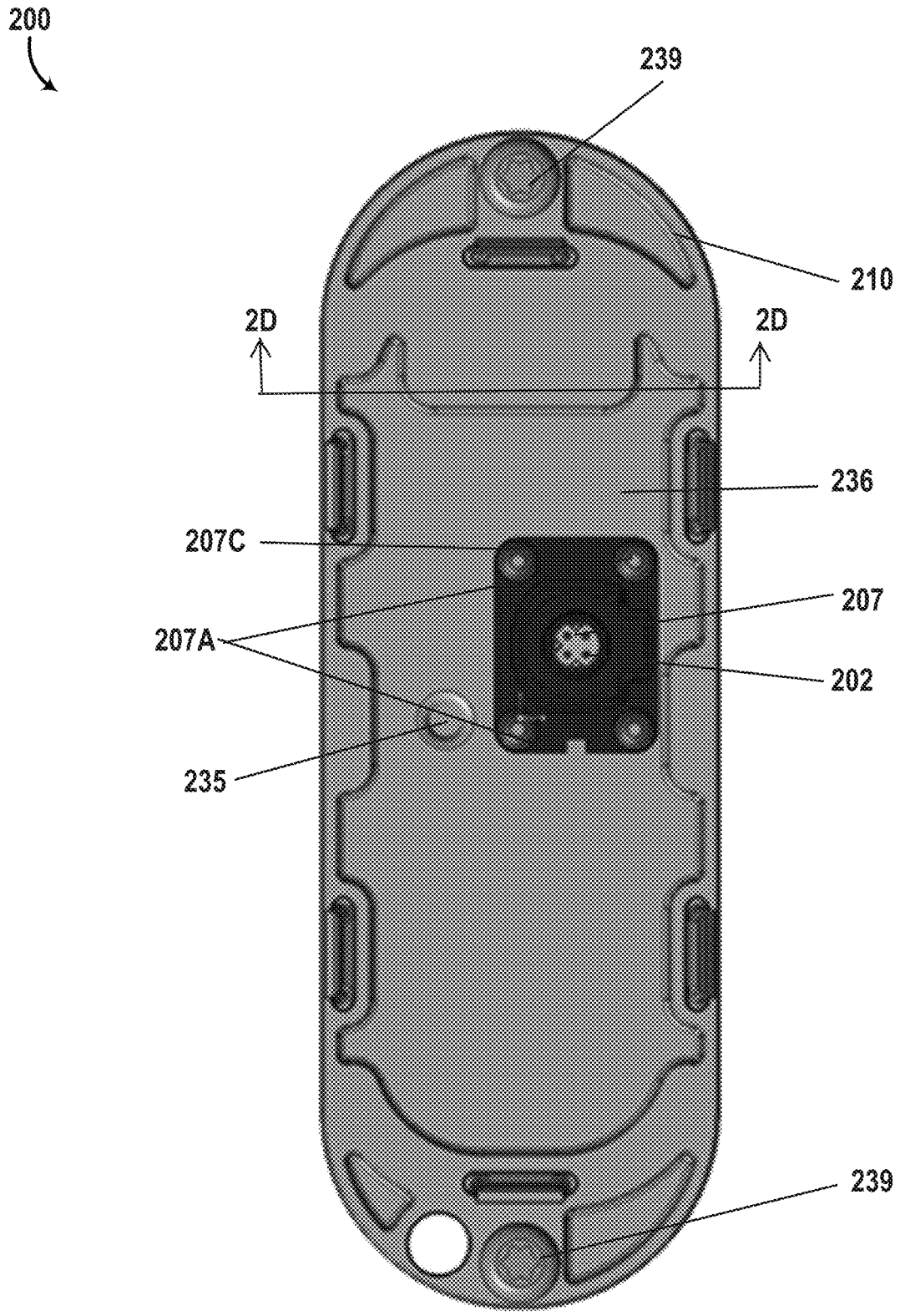
FIG. 2B is a rear perspective view of the microphone module of FIG. 2A.
Figure 2C:
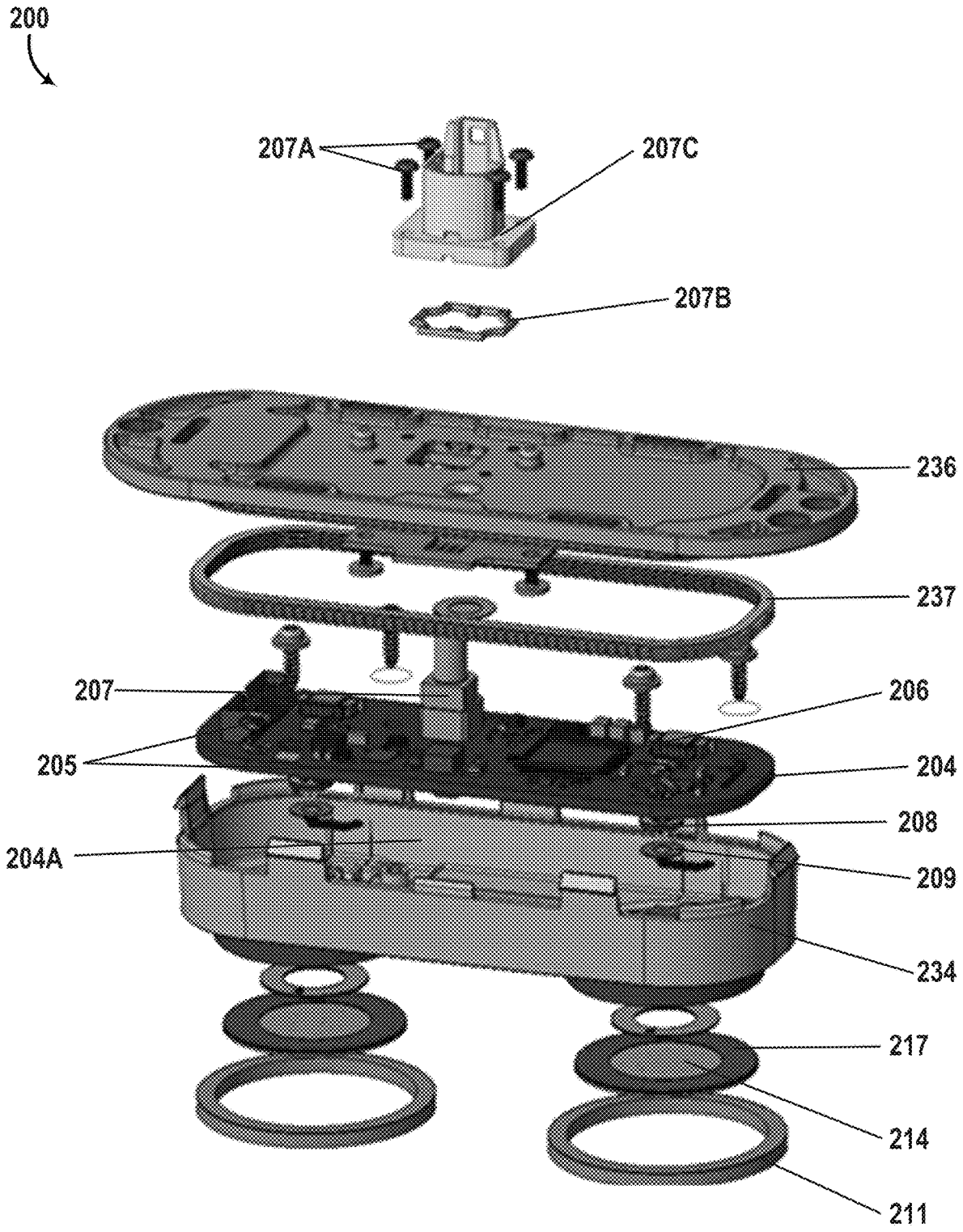
FIG. 2C is an exploded view of the microphone module of FIG. 2A.
Figure 2D:
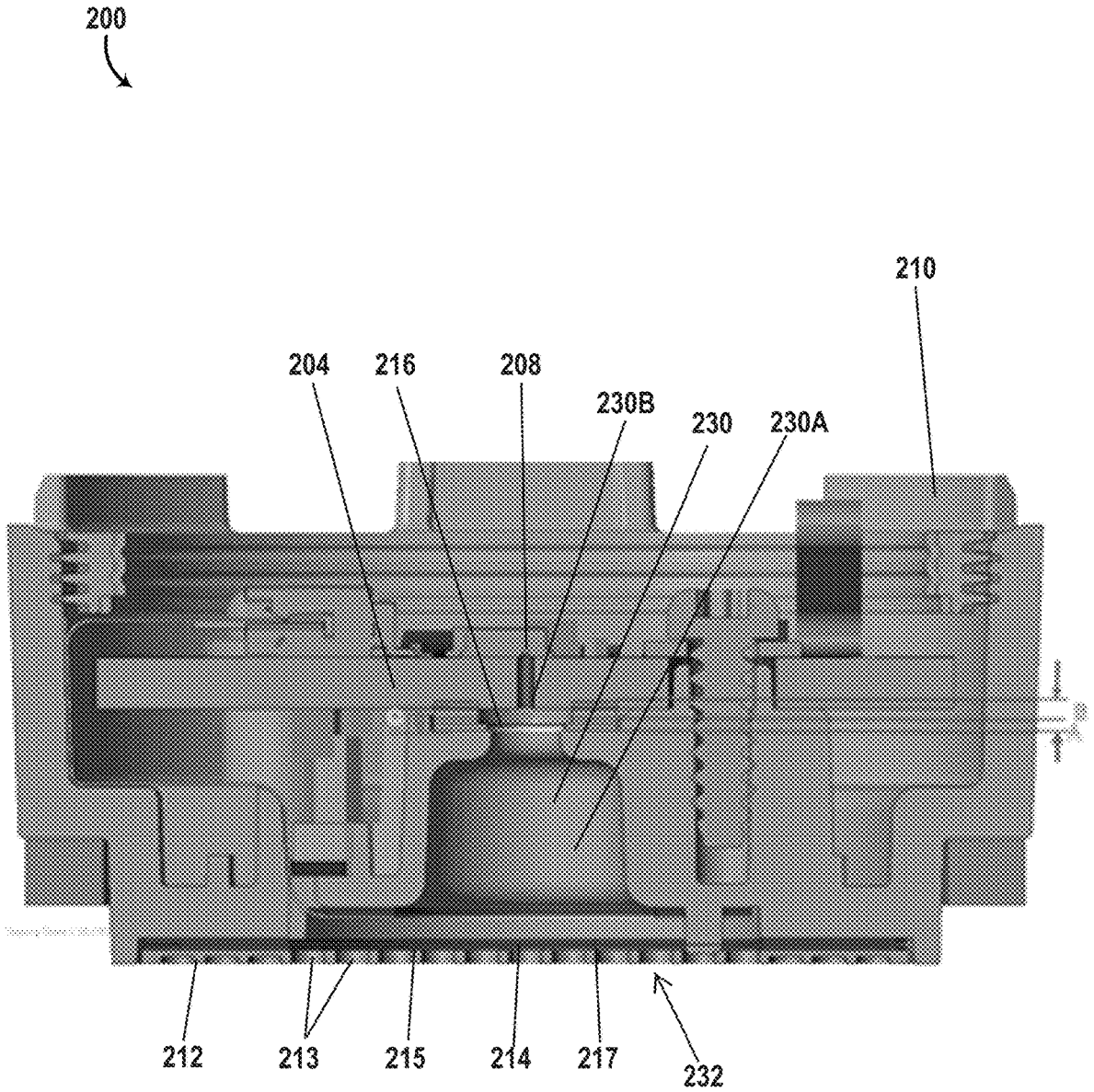
FIG. 2D is a cross-section view of the microphone module of FIG. 2A.

The plurality of apertures 232 pass through the bottom wall 238, allowing fluid communication between the exterior of the housing 210 and a respective internal cavity 230. As shown in FIG. 2D, the internal cavity has a converging shape, with a larger cross-sectional area proximate the aperture 232 and a smaller cross-sectional area proximate the microphone 208. The converging shape directs sound toward the microphone 208.

A sealing ring 211 is positioned around each aperture 232. The sealing ring 211 is made of a deformable material, such as foam. The sealing ring 211 seals the module 200 to the vehicle. The sealing ring 211 additionally reduces the amount of wind noise by at least partially blocking wind proximate the aperture 232.

A first barrier 212 is positioned proximate the aperture 232. The first barrier 212 is a rigid mesh. In one example, the first barrier 212 is a stainless steel woven mesh. Alternatively, the mesh is formed of other materials, such as other metals, plastic, or a fiber-resin material. In some embodiments, the first barrier 212 is integrally formed with the housing 210.

The first barrier 212 has a sufficient perforation ratio to be substantially acoustically transparent. For example, the first barrier 212 could have a perforation ratio of at least 33%. In some embodiments, the first barrier 212 has a perforation ratio of between about 40% and about 50%.

The shown embodiment has round perforations 213 in the first barrier 212. It is understood that other shapes of perforations 213 can be used, such as hexagonal perforations or slit shaped perforations. In one example, the perforations 213 have a diameter of less than about 3 mm. In one form, the perforations have a diameter of less than about 1 mm.

In operation, the first barrier 212 inhibits the passage of debris, such as debris having a size larger than the perforations 213, from passing through the aperture 232. This serves to protect the microphone 208 from common road debris, such as ice, hail, gravel, or other debris.

The second barrier 214 is positioned between the first barrier 212 and the microphone 208. The second barrier 214 is formed of a finer mesh than the first barrier 212 so as to form a dust tight seal. As discussed above, example second barriers 214 have an IP rating of IP5x or IP6x. In some examples, the second barrier 214 is formed of a mesh fabric, such as a polyester monofilament fabric. The second barrier 214 has an acoustic impedance of less than about 100 ohm/cm$^2$. In some forms, the second barrier 214 has an acoustic impedance of less than about 75 ohm/cm$^2$. The second barrier 214 has a pore size of less or equal to about 15 micrometers. In some forms, the second barrier 214 has a pore size of about 12 micrometers.

The second barrier 214 is coupled to the inner surface of the first barrier 212 by a ring 215 of adhesive tape. In some forms, other types of connections are used, such as adhesive. In another form, 214 can be attached to 215 by other materials, such as plastic, through injection molding. In some examples, the ring 215 spaces the second barrier 214 from the first barrier 212. A second ring 217 of adhesive tape couples the second barrier 214 to the housing 210.

In operation, the second barrier 214 inhibits the passage of dust into the cavity 230. The second barrier 214 is air permeable. Accordingly air and sound pass through the second barrier 214 into the cavity 230. In some forms, the second barrier 214 is water permeable.

The third barrier 216 is positioned within the cavity 230 between the second barrier 214 and the microphone 208. The third barrier divides the cavity 230 into a first portion 230A and a second portion 230B. The second portion 230B contains the microphone 208.

The third barrier 216 is formed of a water impermeable material, such as Gore®-Tex or Gore-Vent®. The third barrier 216 forms a water tight seal around the second portion 230B of the cavity 230. In some examples, the third barrier 216 has a rating of between IP62 and IP68. In one example, the third barrier 216 has a rating of IP67. In operation, the third barrier 216 inhibits liquid that passes through the aperture 232 from contacting the microphone 208 or circuit board 204. In some embodiments, the housing 210 includes one or more drain holes configured to remove liquid from the first portion 230A of the cavity 230. Alternatively, the pores of the first barrier 212 and second barrier 214 act as the drains.

The third barrier 216 is spaced from the first barrier 212 by a distance of at least about 2 mm. This spacing reduces the vibration of the third barrier 216 caused by laminar flow of air around the first barrier 212.

In alternative embodiments, the third barrier 216 is air impermeable. The third barrier 216 acts as a diaphragm that vibrates in response to sound in the first portion 230A of the cavity 230. The vibration of the third barrier 216 reproduces the sound in the second portion 230B of the cavity 230, where it is detected by the microphone 208.

As discussed above, the microphone module 200 includes three barriers 212, 214, 216 that provide escalating levels of ingress protection. In alternative embodiments, only two barriers are used to provide escalating ingress protections. For example, the second barrier 214 or the third barrier 216 could be omitted. In still further alternatives, additional barriers could be added in order of escalating ingress protection.

A microphone component 208 is surface-mounted on the circuit board 204. The internal front cavity in the microphone component 208, the hole on the circuit board 204, and the gap between the circuit board 204 and the third barrier 216 is a connected air volume, which is the second portion 230B of the cavity 230. An acoustic seal 209 is a partial or a full foam ring that is positioned between circuit board 204 and the third barrier 216. The acoustic seal 209 dampens sounds, or other vibrations, other than those within the air in the second portion 230B of the cavity 230. This dampening reduces the amount of noise in the audio data which may obscure the desired information.

In operation, the acoustic impedance of the third barrier is negligible as compared to that of the second barrier 214. As a result, parts A and B of the cavity 230 can be regarded as a whole air volume, which is an acoustic capacitor in nature. The air mass within the holes of the first barrier 212 and second barrier 214 can be regarded as a whole, which is an acoustic inductor in nature. The combination of the acoustic capacitor and the acoustic inductor forms a Helmholtz resonator. The sound originates from the exterior of the vehicle and is acoustically filtered by the Helmholtz resonator along the acoustic path before reaching the microphone 208. The resonant frequency of the Helmholtz resonator should be above the higher limit of the target frequency band, e.g. 10 kHz. The microphone generates audio data and sends the data to the transmitter 206 by way of the circuit board 204. In some examples, the circuit board 204 includes components that process the audio data between the microphone 208 and the transmitter 206. For example, the circuit board 204 includes components that filter, compress, and/or convert the audio data before transmission. In some forms, the circuit board 204 includes a high pass filter and/or a low pass filter such that only audio data representing sounds within a certain frequency range is transmitted to the external processor.

The circuit board 204 extends through the housing 210 to couple to multiple microphones 208 in respective microphone cavities 230. The circuit board 204 is attached to the housing 210 proximate the top plate 236. In some forms, the circuit board 204 includes one or more copper springs 205 in contact with the top plate 236. The copper springs 205 ground the circuit board 204 to the vehicle by way of the top plate 236.

Figure 3:
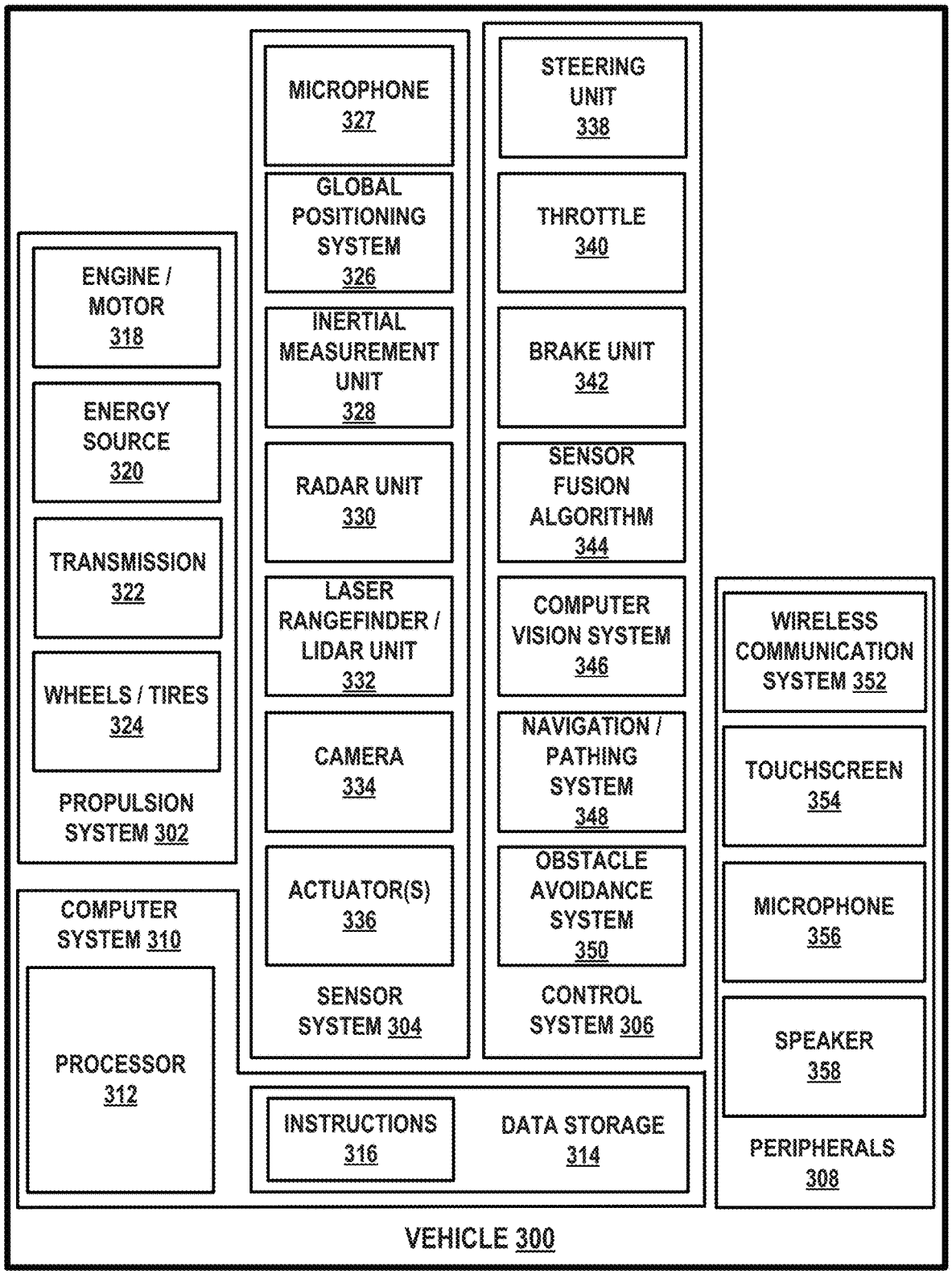
FIG. 3 is a simplified block diagram of a vehicle, according to an example embodiment.

FIG. 3 is a simplified block diagram of a vehicle 300, according to an example embodiment. As shown, the vehicle 300 includes a propulsion system 302, a sensor system 304, a control system 306, peripherals 308, and a computer system 310. In some embodiments, vehicle 300 may include more, fewer, or different systems, and each system may include more, fewer, or different components. Additionally, the systems and components shown may be combined or divided in any number of ways. For instance, control system 306 and computer system 310 may be combined into a single system.

Propulsion system 302 may be configured to provide powered motion for the vehicle 300. To that end, as shown, propulsion system 302 includes an engine/motor 318, an energy source 320, a transmission 322, and wheels/tires 324.

The engine/motor 318 may be or include any combination of an internal combustion engine, an electric motor, a steam engine, and a Sterling engine. Other motors and engines are possible as well. In some embodiments, propulsion system 302 may include multiple types of engines and/or motors. For instance, a gas-electric hybrid car may include a gasoline engine and an electric motor. Other examples are possible.

Energy source 320 may be a source of energy that powers the engine/motor 318 in full or in part. That is, engine/motor 318 may be configured to convert energy source 320 into mechanical energy. Examples of energy sources 320 include gasoline, diesel, propane, other compressed gas-based fuels, ethanol, solar panels, batteries, and other sources of electrical power. Energy source(s) 320 may additionally or alternatively include any combination of fuel tanks, batteries, capacitors, and/or flywheels. In some embodiments, energy source 320 may provide energy for other systems of the vehicle 300 as well. To that end, energy source 320 may additionally or alternatively include, for example, a rechargeable lithium-ion or lead-acid battery. In some embodiments, energy source 320 may include one or more banks of batteries configured to provide the electrical power to the various components of vehicle 300.

Transmission 322 may be configured to transmit mechanical power from the engine/motor 318 to the wheels/tires 324. To that end, transmission 322 may include a gearbox, clutch, differential, drive shafts, and/or other elements. In embodiments where the transmission 322 includes drive shafts, the drive shafts may include one or more axles that are configured to be coupled to the wheels/tires 324.

Wheels/tires 324 of vehicle 300 may be configured in various formats, including a unicycle, bicycle/motorcycle, tricycle, or car/truck four-wheel format. Other wheel/tire formats are possible as well, such as those including six or more wheels. In any case, wheels/tires 324 may be configured to rotate differentially with respect to other wheels/tires 324. In some embodiments, wheels/tires 324 may include at least one wheel that is fixedly attached to the transmission 322 and at least one tire coupled to a rim of the wheel that could make contact with the driving surface. Wheels/tires 324 may include any combination of metal and rubber, or combination of other materials. Propulsion system 302 may additionally or alternatively include components other than those shown.

Sensor system 304 may include a number of sensors configured to sense information about an environment in which the vehicle 300 is located, as well as one or more actuators 336 configured to modify a position and/or orientation of the sensors. As shown, sensor system 304 includes a microphone module 327, a Global Positioning System (GPS) 326, an inertial measurement unit (IMU) 328, a RADAR unit 330, a laser rangefinder and/or LIDAR unit 332, and a camera 334. Sensor system 304 may include additional sensors as well, including, for example, sensors that monitor internal systems of the vehicle 300 (e.g., an $O_2$ monitor, a fuel gauge, an engine oil temperature, etc.). Other sensors are possible as well.

The microphone module 327 may be any sensor (e.g., acoustic sensor) configured to detect and record sounds originating outside of the vehicle 300. For example, the microphone module 327 may be the device 100 or microphone module 200 described above.

GPS 326 may be any sensor (e.g., location sensor) configured to estimate a geographic location of vehicle 300. To this end, the GPS 326 may include a transceiver configured to estimate a position of the vehicle 300 with respect to the Earth.

IMU 328 may be any combination of sensors configured to sense position and orientation changes of the vehicle 300 based on inertial acceleration. In some embodiments, the combination of sensors may include, for example, accelerometers, gyroscopes, compasses, etc.

RADAR unit 330 may be any sensor configured to sense objects in the environment in which the vehicle 300 is located using radio signals. In some embodiments, in addition to sensing the objects, RADAR unit 330 may additionally be configured to sense the speed and/or heading of the objects.

Similarly, laser range finder or LIDAR unit 332 may be any sensor configured to sense objects in the environment in which vehicle 300 is located using lasers. For example, LIDAR unit 332 may include one or more LIDAR devices, at least some of which may take the form of devices 100 and/or 200 among other LIDAR device configurations, for instance.

Camera 334 may be any camera (e.g., a still camera, a video camera, etc.) configured to capture images of the environment in which the vehicle 300 is located. To that end, camera 334 may take any of the forms described above.

Control system 306 may be configured to control one or more operations of vehicle 300 and/or components thereof. To that end, control system 306 may include a steering unit 338, a throttle 340, a brake unit 342, a sensor fusion algorithm 344, a computer vision system 346, navigation or pathing system 348, and an obstacle avoidance system 350.

Steering unit 338 may be any combination of mechanisms configured to adjust the heading of vehicle 300. Throttle 340 may be any combination of mechanisms configured to control engine/motor 318 and, in turn, the speed of vehicle 300. Brake unit 342 may be any combination of mechanisms configured to decelerate vehicle 300. For example, brake unit 342 may use friction to slow wheels/tires 324. As another example, brake unit 342 may convert kinetic energy of wheels/tires 324 to an electric current.

Sensor fusion algorithm 344 may be an algorithm (or a computer program product storing an algorithm) configured to accept data from sensor system 304 as an input. The sensor fusion algorithm 344 is operated on a processor, such as the external processor discussed above. The data may include, for example, data representing information sensed by sensor system 304. Sensor fusion algorithm 344 may include, for example, a Kalman filter, a Bayesian network, a machine learning algorithm, an algorithm for some of the functions of the methods herein, or any other sensor fusion algorithm. Sensor fusion algorithm 344 may further be configured to provide various assessments based on the data from sensor system 304, including, for example, evaluations of individual objects and/or features in the environment in which vehicle 300 is located, evaluations of particular situations, and/or evaluations of possible impacts based on particular situations. Other assessments are possible as well.

Computer vision system 346 may be any system configured to process and analyze images captured by camera 334 in order to identify objects and/or features in the environment in which vehicle 300 is located, including, for example, traffic signals and obstacles. To that end, computer vision system 346 may use an object recognition algorithm, a Structure from Motion (SFM) algorithm, video tracking, or other computer vision techniques. In some embodiments, computer vision system 346 may additionally be configured to map the environment, track objects, estimate the speed of objects, etc.

Navigation and pathing system 348 may be any system configured to determine a driving path for vehicle 300. Navigation and pathing system 348 may additionally be configured to update a driving path of vehicle 300 dynamically while vehicle 300 is in operation. In some embodiments, navigation and pathing system 348 may be configured to incorporate data from sensor fusion algorithm 344, GPS 326, microphone module 327, LIDAR unit 332, and/or one or more predetermined maps so as to determine a driving path for vehicle 300.

Obstacle avoidance system 350 may be any system configured to identify, evaluate, and avoid or otherwise negotiate obstacles in the environment in which vehicle 300 is located. Control system 306 may additionally or alternatively include components other than those shown.

Peripherals 308 may be configured to allow vehicle 300 to interact with external sensors, other vehicles, external computing devices, and/or a user. To that end, peripherals 308 may include, for example, a wireless communication system 352, a touchscreen 354, a microphone 356, and/or a speaker 358.

Wireless communication system 352 may be any system configured to wirelessly couple to one or more other vehicles, sensors, or other entities, either directly or via a communication network. To that end, wireless communication system 352 may include an antenna and a chipset for communicating with the other vehicles, sensors, servers, or other entities either directly or via a communication network. The chipset or wireless communication system 352 in general may be arranged to communicate according to one or more types of wireless communication (e.g., protocols) such as Bluetooth, communication protocols described in IEEE 802.11 (including any IEEE 802.11 revisions), cellular technology (such as GSM, CDMA, UMTS, EV-DO, WiMAX, or LTE), Zigbee, dedicated short range communications (DSRC), and radio frequency identification (RFID) communications, among other possibilities.

Touchscreen 354 may be used by a user to input commands to vehicle 300. To that end, touchscreen 354 may be configured to sense at least one of a position and a movement of a user's finger via capacitive sensing, resistance sensing, or a surface acoustic wave process, among other possibilities. Touchscreen 354 may be capable of sensing finger movement in a direction parallel or planar to the touchscreen surface, in a direction normal to the touchscreen surface, or both, and may also be capable of sensing a level of pressure applied to the touchscreen surface. Touchscreen 354 may be formed of one or more translucent or transparent insulating layers and one or more translucent or transparent conducting layers. Touchscreen 354 may take other forms as well.

Microphone 356 may be configured to receive audio (e.g., a voice command or other audio input) from a user of vehicle 300. Similarly, speakers 358 may be configured to output audio to the user.

Computer system 310 may be configured to transmit data to, receive data from, interact with, and/or control one or more of propulsion system 302, sensor system 304, control system 306, and peripherals 308. To this end, computer system 310 may be communicatively linked to one or more of propulsion system 302, sensor system 304, control system 306, and peripherals 308 by a system bus, network, and/or other connection mechanism (not shown).

In one example, computer system 310 may be configured to control operation of transmission 322 to improve fuel efficiency. As another example, computer system 310 may be configured to cause camera 334 to capture images of the environment. As yet another example, computer system 310 may be configured to store and execute instructions corresponding to sensor fusion algorithm 344. As still another example, computer system 310 may be configured to store and execute instructions for determining a 3D representation of the environment around vehicle 300 using LIDAR unit 332. Thus, for instance, computer system 310 could function as a controller for LIDAR unit 332. Other examples are possible as well.

As shown, computer system 310 includes processor 312 and data storage 314. Processor 312 may comprise one or more general-purpose processors and/or one or more special-purpose processors. To the extent that processor 312 includes more than one processor, such processors could work separately or in combination.

Data storage 314, in turn, may comprise one or more volatile and/or one or more non-volatile storage components, such as optical, magnetic, and/or organic storage, and data storage 314 may be integrated in whole or in part with processor 312. In some embodiments, data storage 314 may contain instructions 316 (e.g., program logic) executable by processor 312 to cause vehicle 300 and/or components thereof (e.g., LIDAR unit 332, etc.) to perform the various operations described herein. Data storage 314 may contain additional instructions as well, including instructions to transmit data to, receive data from, interact with, and/or control one or more of propulsion system 302, sensor system 304, control system 306, and/or peripherals 308.

In some embodiments, vehicle 300 may include one or more elements in addition to or instead of those shown. For example, vehicle 300 may include one or more additional interfaces and/or power supplies. Other additional components are possible as well. In such embodiments, data storage 314 may also include instructions executable by processor 312 to control and/or communicate with the additional components. Still further, while each of the components and systems are shown to be integrated in vehicle 300, in some embodiments, one or more components or systems may be removably mounted on or otherwise connected (mechanically or electrically) to vehicle 300 using wired or wireless connections. Vehicle 300 may take other forms as well.

FIG. 4A illustrates a vehicle 400 equipped with a microphone module 410, according to example embodiments. Vehicle 400 may be similar to vehicle 300, for example. Although vehicle 400 is illustrated as a car, as noted above, other types of vehicles are possible. Furthermore, although vehicle 400 may be configured to operate in autonomous mode, the embodiments described herein are also applicable to vehicles that are not configured to operate autonomously.

Figure 4:
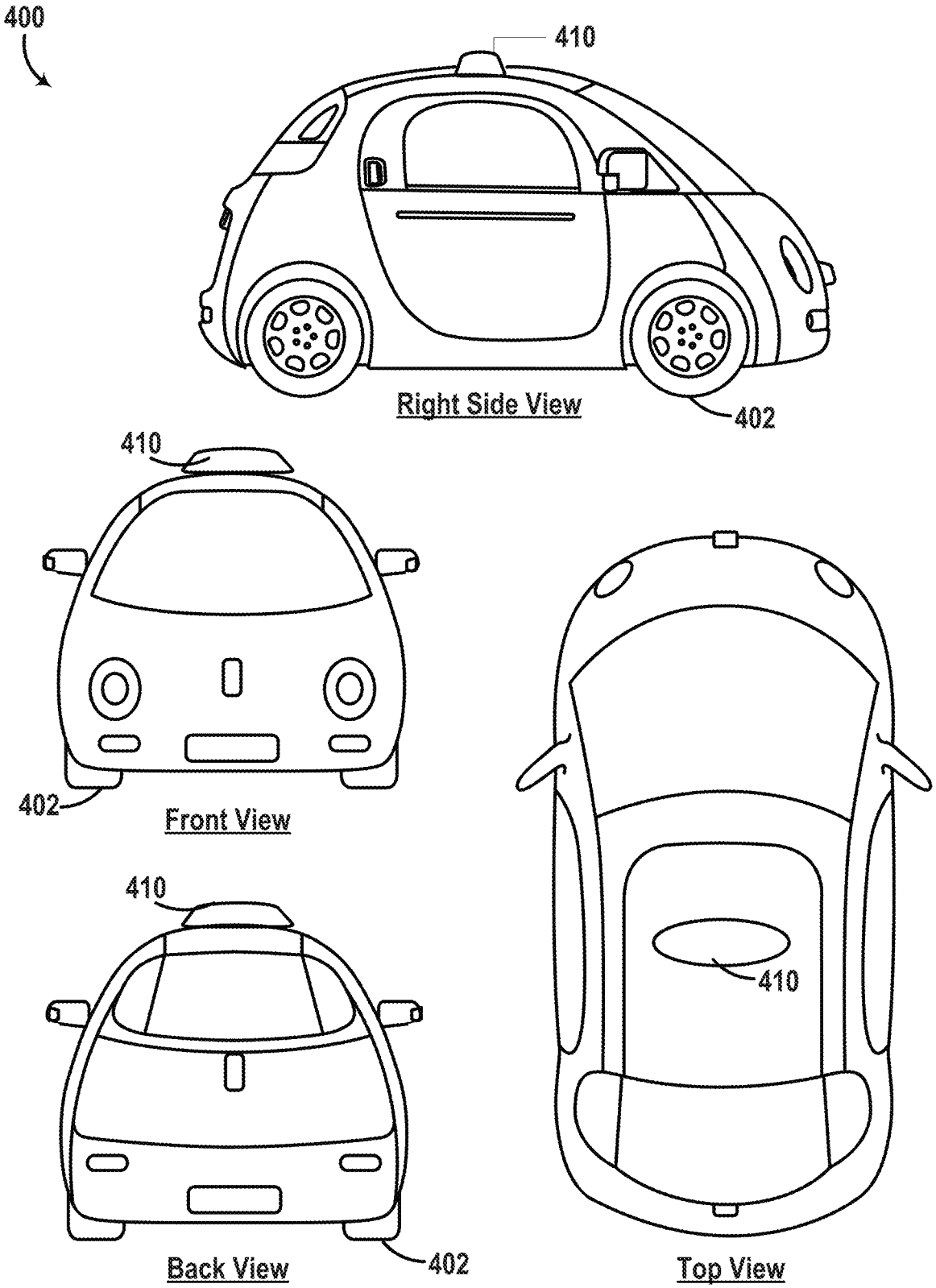
FIG. 4 illustrates several views of a vehicle equipped with a sensor module, according to an example embodiment.

FIG. 4 shows a Right Side View, Front View, Back View, and Top View of vehicle 400. As shown, vehicle 400 includes a microphone module 410 mounted on a top side of vehicle 400 opposite a bottom side on which wheels of vehicle 400, exemplified by wheel 402, are located. The microphone module 410 may be similar to devices 100 and/or 200, for example. Although the microphone module 410 is shown and described as being positioned on a top side of vehicle 400, the microphone module 410 could be alternatively positioned on any other part of vehicle 400, including any other side of vehicle 400 for instance.

The vehicle 400 as shown includes only a single microphone module 410. However, the vehicle 400 could include a plurality of microphone modules 410. The use of multiple microphone modules 410 can be used to determine the direction from the vehicle 400 to the source of the sound. For example, the data representing the same sound as recorded by multiple microphone modules 410 can be compared to triangulate the source of the sound based on the time the sound is heard at each module 410 and/or the amplitude of the sound at each module 410. Alternatively or additionally, the microphone module 410 can include multiple microphones for this same purpose.

The vehicle 400 may also include additional types of sensors mounted on the exterior thereof, such as the LIDAR sensor, RADAR sensor, SONAR sensor, and/or cameras described above.

In operation, the microphone module 410 includes one or more microphones that detect and record sound while the vehicle 400 is in operation. The audio data from the microphone module is transmitted to a sensor fusion algorithm which processes the data to identify important sounds and determine the direction to the source of the sound. In some forms, the audio data is used to identify the source of the sound within a point map of nearby objects generated from data from a camera, LIDAR sensor, SONAR sensor, and/or RADAR sensor.

Based on the sound detected, the control system of the vehicle carries out a preprogrammed action. For example, if the microphone module 410 detects a siren, the control system operates the vehicle 400 to leave the path of the emergency vehicle producing the siren sound, such as by pulling over to the side of the road. Alternatively or additionally, the control system may operate other sensors based on the audio data. For example, the control system may perform a scan in the direction of a horn sound with a camera, LIDAR, SONAR, or RADAR device.

In still further examples, the vehicle 400 includes a user interface such as a screen and/or speaker within the cabin of the vehicle 400. The control system can operate the user interface to notify an individual within the vehicle 400 when particular sounds, such as sirens, are detected.

The particular arrangements shown in the Figures should not be viewed as limiting. It should be understood that other implementations may include more or less of each element shown in a given Figure. Further, some of the illustrated elements may be combined or omitted. Yet further, an exemplary implementation may include elements that are not illustrated in the Figures. Additionally, while various aspects and implementations have been disclosed herein, other aspects and implementations will be apparent to those skilled in the art. The various aspects and implementations disclosed herein are for purposes of illustration and are not intended to be limiting, with the true scope and spirit being indicated by the following claims. Other implementations may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations.

What is claimed:

1. A sensor module comprising:

a housing defining an internal cavity, the housing including an aperture;

at least one microphone positioned in the internal cavity spaced from the aperture;

a first barrier proximate the aperture, wherein the first barrier includes a plurality of perforations;

a second barrier positioned between the at least one microphone and the first barrier, wherein the second barrier is less permeable than the first barrier; and a third barrier positioned between the second barrier and the microphone.

2. The sensor module of claim 1, wherein the first barrier has a perforation ratio of at least 33%.

3. The sensor module of claim 1, wherein the first barrier includes perforations having a diameter of less than about 3 mm.

4. The sensor module of claim 1, wherein the first barrier has a resonance peak that is greater than 10 kHz.

5. The sensor module of claim 1, wherein the second barrier comprises an air permeable fabric.

6. The sensor module of claim 1, wherein the second barrier has an acoustic impedance less than or equal to about 100 ohm/cm$^2$.

7. The sensor module of claim 1, wherein the second barrier has an ingress protection ratio of at least IP54.

8. The sensor module of claim 1, wherein the second barrier comprises a polyester monofilament fabric.

9. The sensor module of claim 1, wherein the third barrier forms a water tight seal around the at least one microphone.

10. The sensor module of claim 1, wherein the third barrier comprises an air impermeable material.

11. The sensor module of claim 1, wherein the third barrier has an ingress protection rating of at least IP62.

12. The sensor module of claim 1, wherein the third barrier has an ingress protection rating of at least IP67.

13. The sensor module of claim 1, wherein the third barrier is less permeable than the second barrier.

14. The sensor module of claim 1, wherein the third barrier is distanced at least 2 mm from the first barrier.

15. A vehicle comprising:

a microphone module including:

a housing defining an internal cavity, the housing including an aperture;

at least one microphone positioned in the internal cavity spaced from the aperture;

a first barrier proximate the aperture, wherein the first barrier includes a plurality of perforations;

a second barrier positioned between the at least one microphone and the first barrier, wherein the second barrier is less permeable than the first barrier; and a third barrier positioned between the second barrier and the microphone; and a control system communicably coupled to the microphone module to receive audio data from the at least one microphone.

16. The vehicle of claim 15, wherein the first barrier has a perforation ratio of at least 33%.

17. The vehicle of claim 15, wherein the first barrier includes perforations having a diameter of less than about 3 mm.

18. The vehicle of claim 15, wherein the first barrier has a resonance peak that is greater than 10 kHz.

19. The vehicle of claim 15, wherein the control system is configured to control operation of the vehicle based on the audio data.

20. The vehicle of claim 15, wherein the third barrier is less permeable than the second barrier.

* * * * *